US006669746B2

(12) United States Patent
Niizaki et al.

(10) Patent No.: US 6,669,746 B2
(45) Date of Patent: Dec. 30, 2003

(54) FILAMENTARY BRUSH BRISTLE MATERIAL

(75) Inventors: Yuuichiro Niizaki, 4-5-8 Higashikaiganminami, Chigasaki-shi, Kanagawa (JP); Tomoko Niizaki, 4-5-8 Higashikaiganminami, Chigasaki-shi, Kanagawa (JP); Yunito Niizaki, Chigasaki (JP)

(73) Assignees: Yuuichiro Niizaki, Chigasaki (JP); Tomoko Niizaki, Chigasaki (JP)

( * ) Notice: Subject to any disclaimer, the term of this patent is extended or adjusted under 35 U.S.C. 154(b) by 0 days.

(21) Appl. No.: 10/020,929

(22) Filed: Dec. 19, 2001

(65) Prior Publication Data

US 2002/0094437 A1 Jul. 18, 2002

(30) Foreign Application Priority Data

Dec. 19, 2000 (JP) ..... 2000-385715

(51) Int. Cl.[7] ..... C09K 3/14

(52) U.S. Cl. ..... 51/298; 51/307; 51/308; 51/309

(58) Field of Search ..... 51/298, 307, 308, 51/309

(56) References Cited

U.S. PATENT DOCUMENTS 5,679,067 A * 10/1997 Johnson et al. ..... 451/527
5,903,951 A * 5/1999 Ionta et al. ..... 15/180
6,190,769 B1 * 2/2001 Wang ..... 428/372

FOREIGN PATENT DOCUMENTS

EP 0 282 243 9/1988
WO WO 00/49208 8/2000

OTHER PUBLICATIONS

Derwent Abstracts, AN 1995–167856, JP 07–090719, Apr. 4, 1995.

* cited by examiner

*Primary Examiner*—Michael Marcheschi
(74) *Attorney, Agent, or Firm*—Oblon, Spivak, McClelland, Maier & Neustadt, P.C.

(57) ABSTRACT

Brush bristles include filaments of synthetic resin material containing two or more types of abrasive particles selected from among diamond powder, stainless-steel powder, titanium powder, silicon carbide powder and aluminum oxide powder or silicon carbide or alumina abrasive grains.

10 Claims, 3 Drawing Sheets

FILAMENTARY BRUSH BRISTLE MATERIAL

BACKGROUND OF THE INVENTION

1. Field of the Invention

The present invention relates to a filamentary brush bristle material that can be used for abrading a work surface and grinding off burrs and the like. It particularly relates to a synthetic resin brush bristle material that contains two or more types of abrasive particles.

2. Description of the Prior Art

As is known, natural fibers, synthetic fibers and metal wire are the principle materials used in brushes for industrial applications, the material used depending on what the work material, the processing mode, and the purpose of use. There are also known brush bristle materials comprising various types of synthetic resin filaments that contain silicon carbide or aluminum oxide powder or abrasive grains.

However, with the prior art brush bristle materials such as those described above, the abrading of burrs cannot be ensured when there is scale on the work surface or when the work material is very hard. Even when the work can be abraded, it takes a long time and is highly inefficient.

An object of the present invention is therefore to provide a brush bristle material that can readily abrade any type of work surface and can be used with high precision for multiple purposes.

SUMMARY OF THE INVENTION

To achieve the above object, the present invention provides a filamentary brush bristle material comprised of synthetic resin material containing two or more types of abrasive particle selected from among diamond powder, stainless-steel powder, titanium powder, silicon carbide powder and aluminum oxide powder or silicon carbide or alumina abrasive grains.

The synthetic resin material can be comprised of a polyamide, a polyolefin such as polyethylene or polypropylene, a vinylidene halide such as polyvinylidene chloride or polyvinylidene fluoride, or a polyester such as polyethylene terephthalate or polybutylene terephthalate, and have a round or polygonal cross-section.

The abrasive particles may be contained in an amount that is from 1 to 90 percent by weight of the synthetic resin material, and preferably is from 10 to 50 percent by weight of the synthetic resin material. The abrasive particles can have a particle diameter of 0.1 $\mu$m to 1 mm, and the filamentary diameter can be from 0.1 mm to 2 mm.

Using a brush bristle material thus comprised of synthetic resin material containing two or more types of abrasive particles not only provides a major improvement in abrading and grinding efficiency and burr removal efficiency resulting from the complementary effect of the characteristics possessed by the synthetic resin and the characteristics possessed by the plurality of powders or abrasive grains, but also makes it possible to reduce the time and labor required to process the work.

Further features of the invention, its nature and various advantages will be more apparent from the accompanying drawings and following detailed description of the invention.

DESCRIPTION OF THE PREFERRED EMBODIMENT

Figure 1:
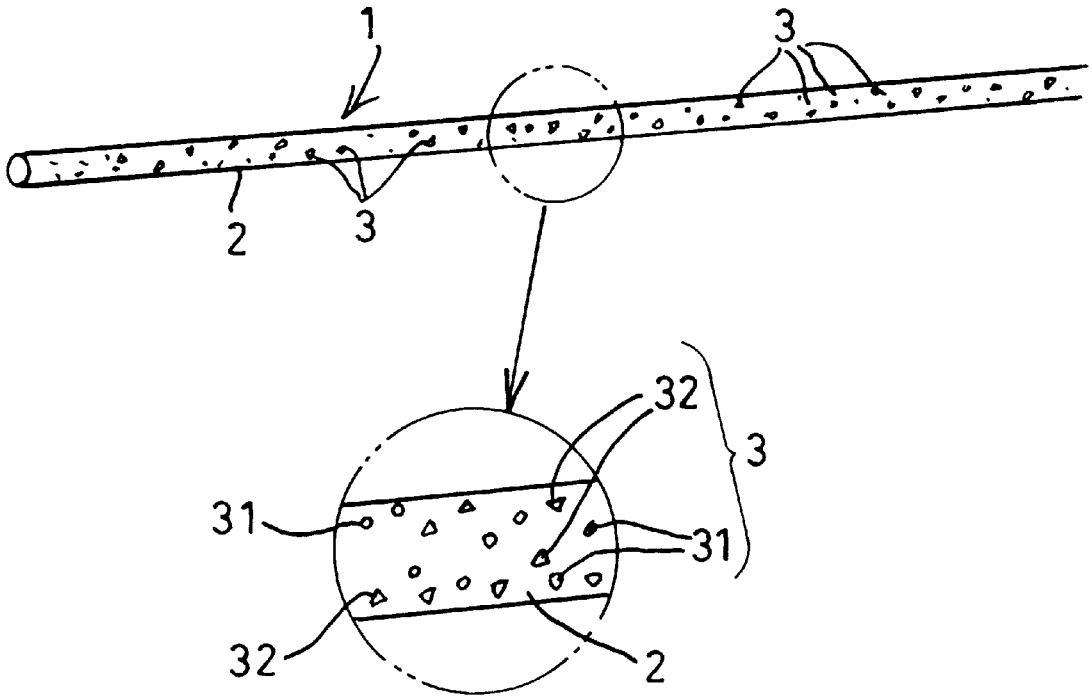
FIG. 1 shows a partially enlarged front view of an embodiment of the brush bristle material of the present invention.

The brush bristle material 1 of the present invention is filamentary in shape and, as shown by FIG. 1, comprises synthetic resin material 2 containing at least two types of abrasive particles 3. As the synthetic resin material 2, there can be used any material that is generally employed as brush bristle material. Preferred materials include a polyamide, a polyolefin such as polyethylene or polypropylene, a vinylidene halide such as polyvinylidene chloride or polyvinylidene fluoride, and a polyester such as polyethylene terephthalate or polybutylene terephthalate.

The two or more types of abrasive particles 3 contained in the synthetic resin material 2 to abrade or grind can be diamond powder, which is hard and has a high abrading and grinding functionality, stainless-steel powder, which has a relatively high abrading and grinding functionality, titanium powder, which has an abrading and grinding functionality and high heat-resistance effect, and silicon carbide powder or aluminum oxide powder, which are generally used. Silicon carbide or alumina abrasive grains can also be effectively used as abrasive particles.

The diameter of the abrasive particles 3 is preferably in the range of 0.1 $\mu$m to 1 mm. When it is less than 0.1 $\mu$m, the particles fail to function as the abrasive particles. When it exceeds 1 mm, it is difficult for the abrasive particles to be contained in the synthetic resin material 2.

The brush bristle material 1 shown in FIG. 1 is comprised of synthetic resin material 2 containing a mixture of, by weight, 30 parts of diamond powder 31 and 70 parts of silicon carbon powder 32. The two powders account for 25% by weight of the synthetic resin material 2. When a brush formed by bundling a plurality of filaments of the brush bristle material 1 is used for abrading and grinding work or for removing burrs, the functionality of each powder can be exhibited. The brush bristle material 1 of FIG. 1 contains diamond powder 31, which has a powerful abrading functionality, and silicon carbon powder 32, in a ratio of 30 parts by weight of diamond powder 31 to 70 parts by weight of silicon carbon powder 32. As a result, the brush bristles have a higher abrading effect than brush bristles that use just silicon carbide powder.

The synthetic resin material contains 1 to 90 weight-percent of abrasive particles, and more preferably 10 to 50 weight-percent. If the content of the abrasive particles is less than 1 weight-percent, the abrasive qualities thereof will not be exhibited, while if the content goes above 90 weight-percent, it becomes difficult to form the filaments. The diameter of the filaments of the brush bristle material 1 is from 0.1 mm to 2 mm. Filaments having a smaller diameter will lack stiffness, making them unsuitable for use in a brush used for abrading. Filaments having a larger diameter will limit the industrial applicability of the brush.

There is no particular limitation on the cross-section of the synthetic resin material 2, which can be round, or in the shape of a regular or irregular polygon. With a round cross-section, the abrading of the work is made smoother by the end-face portions, owing to the peripheral curved shape thereof, while in the case of a polygonal cross-section, the periphery has a linear shape and the apical portion also has an abrading function, enabling stronger contact that improves the work process efficiency.

Figure 2:
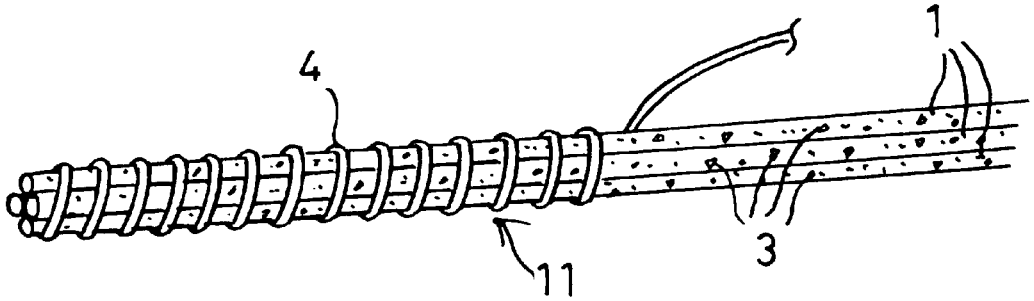
FIG. 2 shows a front view of a first example of the application of the brush bristle material of the invention.

FIG. 2 shows a first application example of the brush bristle material of the invention. This comprises a plurality of the brush bristle material 1 filaments containing a mixture of two or more types of the abrasive particles 3, aligned and bound by binding-wire 4 wound in a spiral around the circumference to form filamentary brush bristle material 11. With the inclusion of one, two or more types of abrasive powder in the binding-wire 4 of the brush bristle material 11, as in the synthetic resin material 2 of the brush bristle material 1, the binding-wire 4 can also be used to abrade the work. However, the binding-wire 4 does not have to include abrasive powder.

Figure 3:
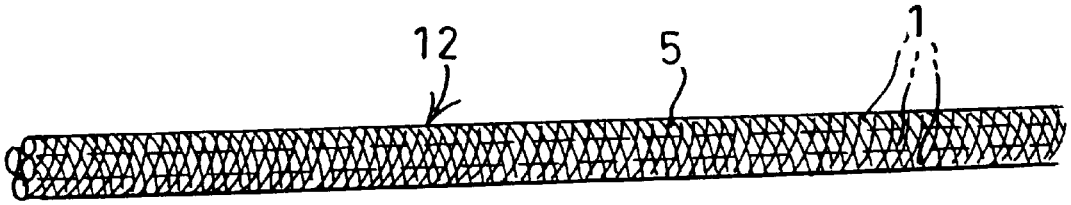
FIG. 3 shows a front view of a second example of the application of the brush bristle material of the invention.

FIG. 3 shows a second application example of the invention, in which a plurality of filaments of the brush bristle material 1 containing a mixture of two or more types of the abrasive particles 3 is aligned and bound by netting 5 to form filamentary brush bristle material 12. The netting 5 can also be formed of resin containing abrasive particles, or of material not containing abrasive particles.

Figure 4:
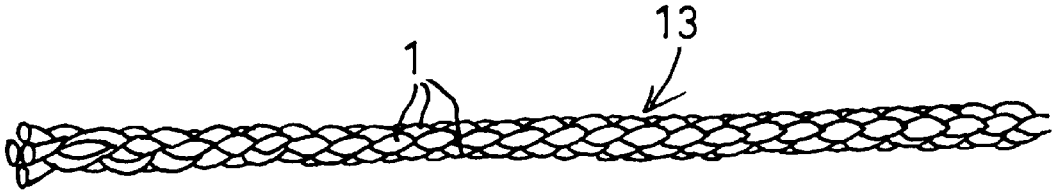
FIG. 4 shows a front view of a third example of the application of the brush bristle material of the invention.
Figure 5:
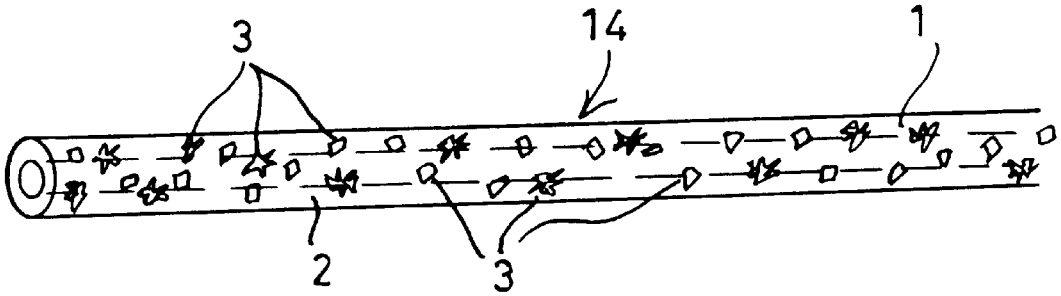
FIG. 5 shows a front view of a fourth example of the application of the brush bristle material of the invention.

FIG. 4 shows a third application example of the invention, in which a plurality of filaments of the brush bristle material 1 containing a mixture of two or more types of the abrasive particles 3 is twisted into a single strand of brush bristle material 13. FIG. 5 shows a fourth application example of the invention in which the brush bristle material 1 containing two or more types of abrasive particles is formed as a cylindrical brush bristle material 14. In the first to third application examples, each of the filaments is coated with a liquid adhesive, and the filaments are then bundled together and the adhesive allowed to dry, forming bonding the filaments together to form brush bristles having good stiffness.

Figure 6:
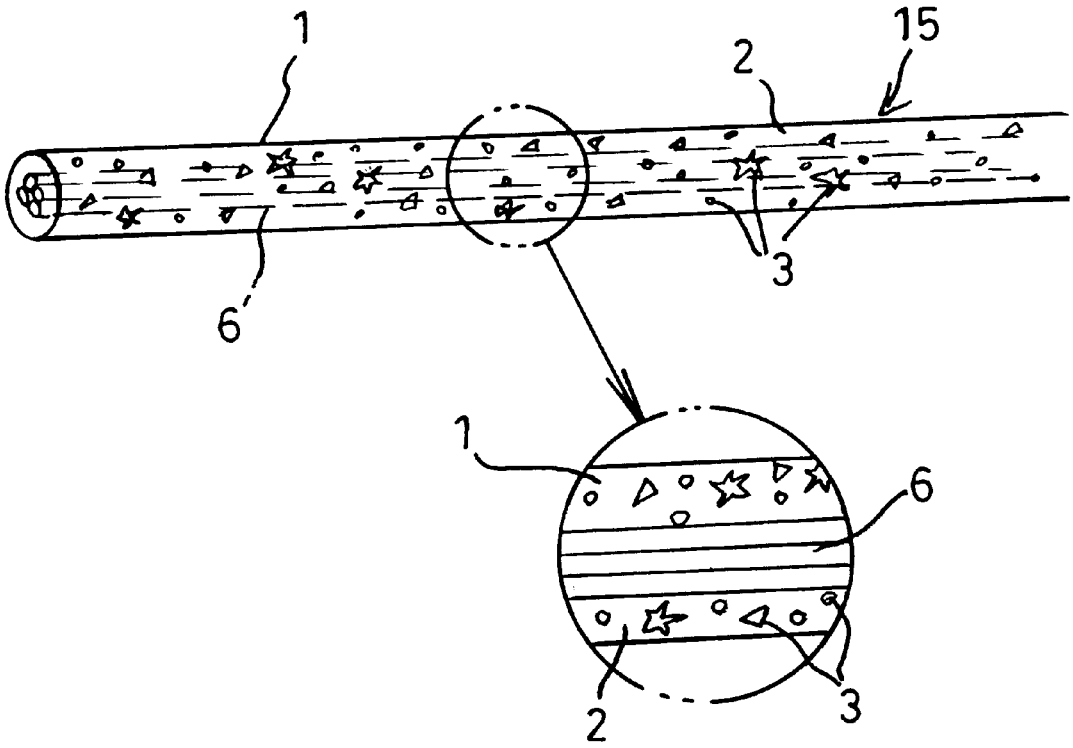
FIG. 6 shows a front view of a fifth example of the application of the brush bristle material of the invention.

FIG. 6 shows a fifth application example of the brush bristle material of this invention in which metal wire 6 is integrally inserted into brush bristle material 1 containing two or more types of abrasive particles to form brush bristle material 15. With such bristles, the work can be abraded and burrs removed by the ends constituted by abrasive particles, resin and metal wires, making it possible to configure the brush for the material and shape of the work concerned. With respect to the fifth application example, instead of the metal wire 6, there can be inserted synthetic resin or natural fiber filaments containing or not containing abrasive particles, or any other type of filamentary material used in brushes.

Figure 7:
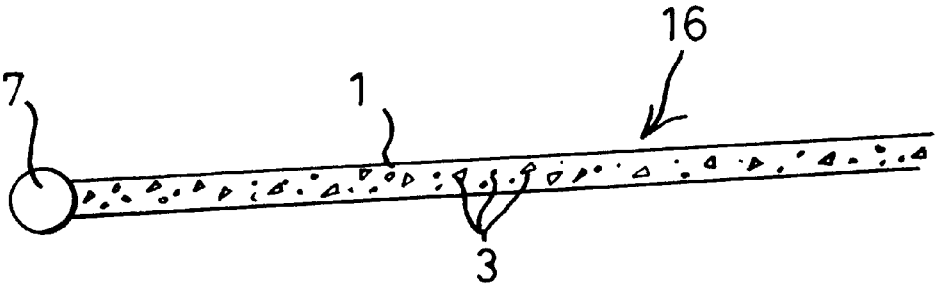
FIG. 7 shows a front view of a sixth example of the application of the brush bristle material of the invention.

FIG. 7 shows a sixth application example of the brush material of the invention, comprising the brush bristle material 1 containing two or more types of abrasive particles. In this example, a synthetic resin sphere 7 is affixed to one or both ends of each strand of the brush bristle material 1, forming brush bristle material 16. The sphere 7 on the ends provides a smoother contact with the work, and is therefore suitable for finish lapping. The sphere 7 can be affixed to the end of the brush bristles by heating the ends to soften the material 1 and then pressing the sphere 7 onto the end, or the material 1 and sphere 7 can be heated for contact bonding. The sphere 7 can include or not include abrasive particles.

A brush using the above-described brush bristle material can be fabricated by bundling a plurality of bristle filaments together, using a channel jig, or the bristles can be inserted directly into the brush base and bonded, to form a roll brush, coil brush, wheel brush, cup brush, a twist brush, and so forth. To abrade or grind a work surface or to remove burrs inside holes in the work, the ends of the bristles are pressed on the work and the brush rotated in one or both directions. This ensures that the work is properly abraded, ground or deburred. Moreover, since the bristle material contains two or more types of abrasive particles, the surface of the work can be processed using the right brush bristle material for the work material or structure concerned.

Brushes can be configured using the above brush bristle material containing two or more types of abrasive particles, and brush bristles of synthetic fiber containing or not containing abrasive grains or powder, brush bristles comprised of pig bristle, horsehair or other animal fibers, wire brush material comprised of stainless-steel, piano wire or copper wire or the like, or metal brush bristle materials comprising metal wire having a surface plating or electro-deposition containing diamond powder, titanium powder, stainless-steel powder or other powder or abrasive particles. The brush materials used can be combined depending on the work material, the processing objective, the part being processed, and so forth.

While the invention has been described with reference to the embodiments shown in the drawings, the invention is not limited to the illustrated embodiments. Instead, other arrangements can be used to the extent that any such other arrangement does not depart from the defined scope of the invention.

To summarize, the present invention comprises a filamentary brush bristle material of synthetic resin material containing two or more types of abrasive particle selected from among diamond powder, stainless-steel powder, titanium powder, silicon carbide powder and aluminum oxide powder, or silicon carbide or alumina abrasive grains. The mutually complementary effect of the characteristics possessed by the synthetic resin and the characteristics possessed by the plurality of powders or abrasive grains provides a major improvement in abrading and grinding efficiency and burr removal efficiency, and also makes it possible to reduce the time and labor required to do the work. Moreover, brushes made by combining different types of bristles have the same functions, so brushes can be made to order in accordance with the work material concerned, the aim of the processing, the part to be processed, and so forth, further enhancing the practical value of the invention.

What is claimed is:

1. A filamentary brush bristle material comprised of synthetic resin material containing abrasive particles of stainless-steel powder and at least one additional type of abrasive particles selected from the group consisting of diamond powder, titanium powder, silicon carbide and aluminum oxide.

2. The filamentary brush bristle material according to claim 1, wherein the synthetic resin material comprises a polyamide, a polyolefin, a vinylidene halide, or a polyester.

3. The filamentary brush bristle material according to claim 1, wherein the bristle material has a round or polygonal cross-section.

4. The filamentary brush bristle material according to claim 2, wherein the bristle material has a round or polygonal cross-section.

5. The filamentary brush bristle material according to claim 1, wherein the abrasive particles are contained in an amount that is from 1 to 90 percent by weight of the synthetic resin material.

6. The filamentary brush bristle material according to claim 1, wherein the abrasive particles have a particle diameter of from 0.1 $\mu$m to 1 mm.

7. The filamentary brush bristle material according to claim 1, wherein a filamentary diameter is from 0.1 mm to 2 mm.

8. The filamentary brush bristle material according to claim 1, wherein the synthetic resin material comprises a polyolefin selected from the group consisting of polyethylene and polypropylene.

9. The filamentary brush bristle material according to claim 1, wherein the synthetic resin material comprises a vinylidene halide selected from the group consisting of polyvinylidene chloride and polyvinylidene fluoride.

10. The filamentary brush bristle material according to claim 1, wherein the synthetic resin material comprises a polyester selected from the group consisting of polyethylene terephthalate and polybutylene terephthalate.

* * * * *